United States Patent [19]

Kawai et al.

[11] Patent Number: 4,669,272

[45] Date of Patent: Jun. 2, 1987

[54] VARIABLE DISPLACEMENT REFRIGERANT COMPRESSOR OF VARIABLE ANGLE WOBBLE PLATE TYPE

[75] Inventors: Katsunori Kawai; Hiroyuki Deguchi; Hisao Kobayashi; Shuichi Sugizono, all of Kariya, Japan

[73] Assignee: Kabushiki Kaisha Toyoda Jidoshokki Seisakusho, Kariya, Japan

[21] Appl. No.: 875,314

[22] Filed: Jun. 17, 1986

[30] Foreign Application Priority Data

Jun. 27, 1985 [JP] Japan ..... 60-141968

[51] Int. Cl.[4] ..... F25B 1/00; F04B 1/26

[52] U.S. Cl. ..... 62/228.3; 62/217; 417/270

[58] Field of Search ..... 62/228.3, 228.5, 228.1, 62/197, 217; 417/269, 270, 222, 218

[56] References Cited

U.S. PATENT DOCUMENTS

| | | | |
|---|---|---|---|
| 3,810,488 | 5/1974 | Orth et al. | 62/217 X |
| 3,998,570 | 12/1976 | Jacobs | 62/228.3 X |
| 4,132,086 | 1/1979 | Kountz | 62/228.5 X |
| 4,428,718 | 1/1984 | Skinner | 417/270 X |

*Primary Examiner*—Harry Tanner

*Attorney, Agent, or Firm*—Brooks Haidt Haffner & Delahunty

[57] ABSTRACT

A variable displacement refrigerant compressor of the variable angle wobble or swash plate type is disclosed. The compressor according to the invention has a displacement control valve which is operable in response to the evaporator pressure so as to restrict the drop thereof by throttling the refrigerant gas flowing through a control port disposed between the evaporator and suction chamber. Crankcase of the compressor is arranged for direct communication with the evaporator so as to keep the crankcase under a pressure which is substantially the same as the evaporator pressure.

7 Claims, 5 Drawing Figures

VARIABLE DISPLACEMENT REFRIGERANT COMPRESSOR OF VARIABLE ANGLE WOBBLE PLATE TYPE

FIELD OF THE INVENTION

The present invention relates generally to a variable displacement refrigerant compressor with a variable angle wobble or swash plate drive mechanism. More specifically, it relates to a control device operable in response to the evaporator pressure for controlling the displacement of the refrigerant compressor of the above type.

BACKGROUND OF THE INVENTION

A typical variable displacement refrigerant compressor of the variable angle wobble plate type is disclosed, e.g., by the U.S. Pat. No. 4,428,718, wherein its displacement or capacity is varied automatically according to air conditioning demand by controlling the refrigerant gas pressure differential between the crankcase and suction chamber by means of a control valve which is actuated by a bellows operable in response to suction pressure of the refrigerant gas. According to this prior art, the bellows is so arranged that, when the suction pressure is dropped to a predetermined control point, it acts on the control valve in such a way that the latter is brought to a position where a communication passage between the crankcase and suction chamber is closed and, simultaneously, another passage for establishing communication between the discharge chamber and crankcase is opened to elevate the crankcase pressure. As a result, the above crankcase-suction pressure differential is increased, thus causing the compressor to operate at a reduced displacement while preventing the suction pressure from being dropped beyond a set level.

With the compressor wherein the displacement control valve is thus actuated by the bellows operable in response to the suction pressure, however, if a rapid drop takes place in suction pressure because of, e.g. accelerating operation, the control valve will be actuated by the bellows then responding to such drop of the suction pressure. Thus, the compressor is brought into operation at a reduced displacement only by a decrease of the suction pressure without increasing the crankcase pressure. As a result of the above actuation of the control valve, however, the passage between the discharge chamber and crankcase is opened to admit compressed high pressure gas into the crankcase, thereby crankcase pressure being built up to an excessive level. When the compressor speed is reduced to a normal level after completion of the above acceleration, however, the compressor tends to operate at a displacement which is insufficient for the cooling capacity demand then increased so as to compensate for the capacity insufficiently resulting from the acceleration during which the compressor displacement was reduced. It is because the suction pressure is increased with the decrease of the compressor speed and also with the above increased cooling capacity demand and, therefore, the crankcase-suction pressure differential prevailing after such acceleration is not large enough to restore the wobble plate rapidly to its full stroke position and the excessively elevated crankcase pressure can be reduced only at a slow rate. As a result, not only the temperature in the automobile's interior is elevated, but also it takes a long time before the optimum temperature is reached because it is necessary to move the wobble plate to its maximum angle position for decreasing the ambient temperature again to the optimum level. Furthermore, because an excessive high crankcase pressure results whenever the compressor speed is accelerated, there is a fear that sealing surfaces of shaft seals disposed in the crankcase may be deteriorated by frequent variation of the crankcase pressure.

There has been another disadvantage with the conventional compressor in that, once the wobble plate is brought to its zero displacement or non-compression position with the inceasing crankcase-suction pressure differential, the wobble plate is unable to release itself from such zero displacement state for restoration to a position of, e.g., about 20 degree or more. This means that the wobble plate requires any means for urging the same toward its full displacement position, which will not only make the compressor mechanism more complicated in construction, but also restrict the range controllable by the pressure differential.

Furthermore, the compressor which vents the discharge chamber to the crankcase is disadvantageous because the compression efficiency is decreased by part of the compressed high pressure refrigerant gas escaping from the discharge chamber into the crankcase and also a costly three-way valve is used as the displacement control valve.

SUMMARY OF THE INVENTION

An object of the present invention is to provide a variable displacement refrigerant compressor of the variable angle wobble or swash plate type which can remove the aforementioned disadvantages of conventional compressors.

The compressor according to the present invention has a displacement control valve which is operable in response to evaporator pressure for effecting controlled communication between the evaporator and suction chamber by throttling the refrigerant gas flowing through a control port disposed between the evaporator and suction chamber. The control valve is adapted to operate for the throttling of refrigerant gas with a decrease in the evaporator pressure so that further drop thereof may be restricted. The crankcase of the compressor is formed in direct communication with the evaporator so as to keep the crankcase under a pressure which is substantially the same as the evaporator pressure.

In operation of the compressor with such control valve kept where the above control port is wide open under a high cooling capacity demand, the pressure differential between the crankcase and suction chamber is kept at minimum and, therefore, the compressor is operated at its full displacement or capacity. As the evaporator pressure is being dropped, the control valve then responding to such drop of the evaporator pressure is actuated to move for throttling the refrigerant gas passing through the control port. In this state of the control valve in which the evaporator pressure counterbalances the force urging the valve in opposite direction, the compressor is operated at a partial displacement. When the control port is closed with a further drop of the evaporator pressure with a decreasing cooling capacity demand, the suction pressure is decreased while the evaporator pressure is maintained substantially at and not lower than a level of a control point. The crankcasesuction pressure differrential is then increased to its maximum value and the compressor is operated at its minimum displacement, accordingly, If the compressor speed is increased at a rapid rate by accelerating the engine, the suction pressure is caused to drop rapidly, but the crankcase pressure can be held substantially constant by the control valve which is then operated to close the control port, so that the compressor is run at a reduced capacity at which the load to be imposed on the engine is minimized for improved accelerating operation. After the acceleration is over, the capacity can be restored to the level before the acceleration quickly enough to minimize the elevation of the ambient temperature during accelerating operation.

Thus, the displacement control valve for the compressor of the present invention performs the function of restricting or throttling the refrigerant gas passing through the control port, as well as of maintaining the crankcase pressure not lower than a predetermined control point. This function by which to decrease the flow of refrigerant gas through the control port into the suction chamber when the cooling capacity demand is low can contribute to reduction of the cooling capacity.

According to the invention, the wobble plate's minimum angle of tilt, when the crankcase-suction pressure differential is at minimum, can be established at, e.g., 6 degrees where the wobble plate can move itself toward its full stroke position, without narrowing the controllable range of displacement. This feature of the invention can make it possible to dispense with means for urging the wobble plate toward the full stroke position, thus contributing to simplified construction of the compressor.

Furthermore, shaft seals disposed in the crankcase can be placed under a substantially constant and low pressure because the crankcase pressure of the compressor of the invention is maintained substantially at a constant level, regardless of variation in the cooling capacity demand or the manner of compressor operation such as acceleration, once an optimum temperature is reached in the space to be cooled, and also because the crankcase which is always in communication with the evaporator, without being vented to discharge chamber, is always under a low pressure atmosphere. As a result, development of harmful heat in shaft seals provided in the crankcase due to application of excessively high pressures can be prevented, thus making possible improved shaft sealing.

Additionally, the control valve of the invention can perform the function of displacement controlling without venting the discharge chamber to the crankcase. This manner of controlling offers an advantage in that the loss is compression efficiency due to such venting can be removed and also a complicated hence costly three-way valve be dispensed with.

The above and other objects and features of the present invention will be apparent from the following detailed description of the preferred embodiment thereof in conjunction with the accompanying drawings.

DETAILED DESCRIPTION OF THE PREFERRED EMBODIMENT

Figure 1:
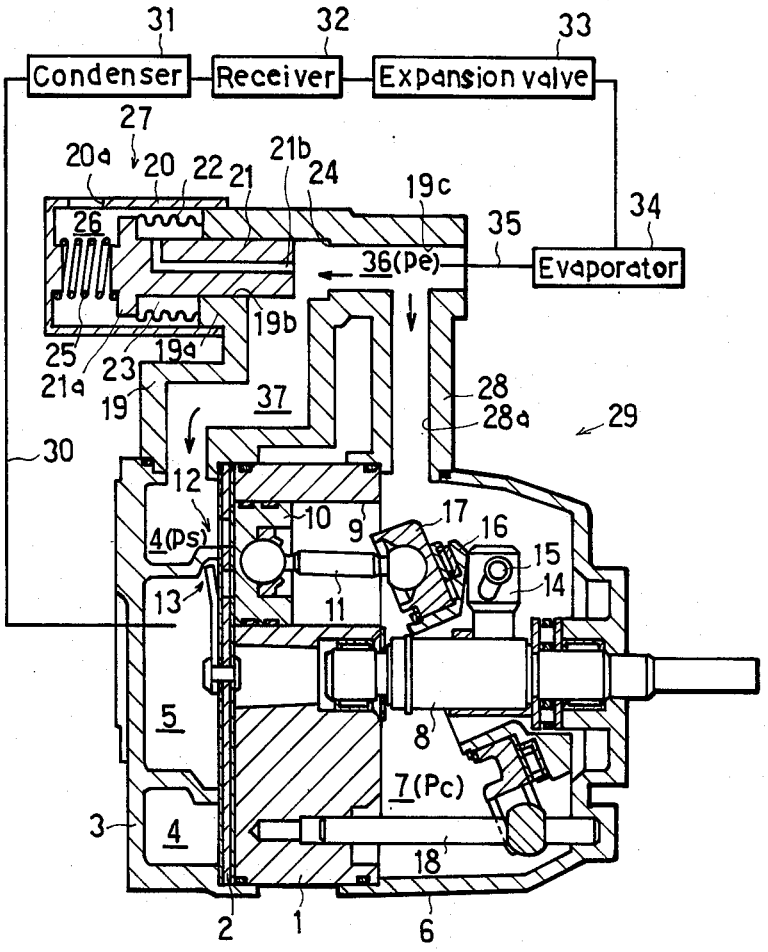
FIG. 1 is a cross-sectional view of a variable displacement refrigerant compressor of the variable angle wobble plate type having incorporated therein the preferred embodiment of the displacement control valve arrangement according to the present invention, said valve being shown in its wide-open position for full capacity operation of the compressor.

Referring to FIG. 1, there is shown a variable displacement refrigerant compressor 29 of the variable angle wobble plate type in accordance with the present invention, the compressor being arranged in an automotive air conditioning system (being shown schematically) and having a condenser 31 connected to the compressor's discharge side by way of a discharge line 30, a receiver 32, an expansion valve 33 and an evaporator 34 connected to the suction side of the compressor via a suction line 35. The compressor 29 includes a cylinder block 1 having at one end thereof a rear housing 3 sealingly clamped thereto with a valve plate 2 interposed between the cylinder block 1 and the rear housing 3. The latter rear housing 3 is formed at its inner periphery with a substantially annular suction cavity or chamber 4 and at its center with a discharge cavity or chamber 5, respectively. To the opposite front end of the cylinder block 1 is sealingly clamped a front housing 6, which cooperates with the cylinder block 1 to form therein a crankcase 7 in which the compressor mechanism is disposed. A drive shaft 8 is rotatably supported in the compressor 29 at the cylinder block 1 and front housing 6, extending through the front housing for connection to an automotive engine (not shown).

The cylinder block 1 has formed therethrough axial bores or cylinders 9, e.g. six cylinder (only one being shown), which are equally angularly spaced around and in parallel to the drive shaft 8. Each cylinder 8 receives therein a slidably reciprocable piston 10 having a piston rod 11 connected thereto by a spherical rod end which is retained in a socket on the backside of the piston. The valve plate 2 is provided with a suction valve 12 for admitting refrigerant gas from the suction chamber 4 into a working or compression chamber defined by each cylinder 9 and also with a discharge valve 13 for allowing the compressed refrigerant gas to be discharged into the discharge chamber 5 and thence delivered to the condenser 31.

The drive shaft 8 carries a drive lug 14 fixedly mounted thereto and a rotary drive plate 16 which is tiltably mounted in a known way on the drive shaft 8 by way of a cross pin 15 inserted through an elongated slot formed in the drive lug 14 for guiding the tilting angulation of the drive plate 16 while rotating with the drive shaft 8 and drive lug 14. A non-rotary swash or wobble plate 17 is supported tiltably by the drive plate 16 for wobbling and angulating therewith. Though the wobble plate 17 is tiltable with the rotary drive plate 16, it is prevented from rotating therewith by a guide rod 18 which is retained at opposite ends in the cylinder block 3 and crankcase 6 in parallel to the drive shaft 8. The opposite end of each piston rod 11 is connected to the wobble plate 17 by a spherical rod end so that the wobbling movement of the plate 17 may cause the piston 10 to slide reciprocally in the cylinder 9. The angle of tilt at which the plate 17 wobbles is varied with respect to the axis of the drive shaft 8 between the maximum angle position shown in FIG. 1 for full stroke displacement of the compressor and the minimum angle position corresponding to minimum stroke displacement to thereby infinitely vary the stroke of the pistons 10 and hence the compressor's displacement or capacity between these two extremes. The length of the stroke that the piston 10 moves reciprocally is controlled and determined by the pressure differential between the crankcase 7 and suction chamber 4 which is varied according to air conditioning or refrigerating capacity demand.

Figure 2:
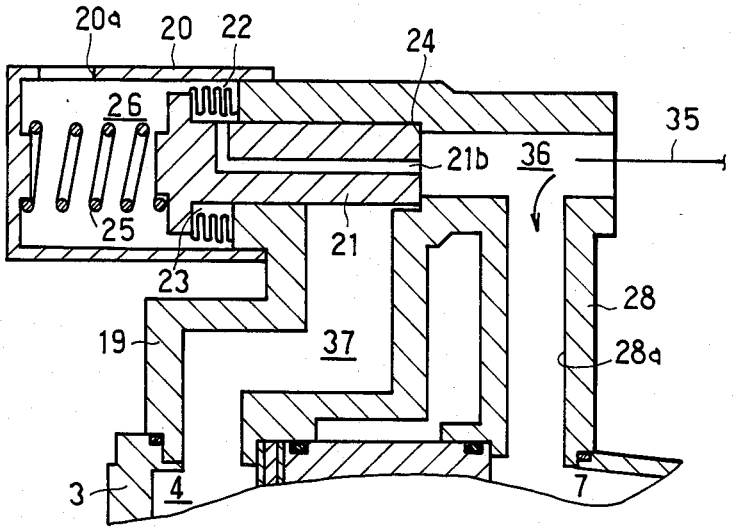
FIG. 2 is a cross-sectional view of the displacement control valve shown in its closed position for the minimum capacity operation of the compressor.

Referring to FIGS. 1 and 2, a member 19 defining therein refrigerant gas passages, preferably in the form of a flange, is sealingly clamped to the compressor 29 in such a way to provide communication between the outlet of the evaporator 34 and the suction chamber 4. A cylindrical cap 20 is screwed over a boss portion 19*a* of the flange member 19 and a cylindrical valve body 21 having a shape similar to a spool is slidably mounted in a bore 19*b* formed centrally through the boss portion 19*a*. Between one end 21*a* of the valve body 21 and the boss portion 19*a* of the flange member 19 is located a bellows 22 which cooperates with the valve body 21 to form therebetween a pressure-responsive cell 23 which communicates with a suction passage 19*c* in the flange member 19 by way of a communication passage 21*b* bored in the valve body 21. Between the valve body 21 and the closed end of the cap 20 is mounted a coil spring 25 for urging the valve body 21 toward a position where it closes off a throttling or control port 24 which is formed as a stepped portion in the suction passage 19*c* and cooperates with the valve body 21 to form a valving arrangement. The cavity formed in the cap 20 on the side of the spring 25 provides a atmospheric cell 26 which communicates with the atmosphere through an external hole 20*a* formed through the cap 20. The cap 20, valve body 21, bellows 22 and spring 25 are thus combined to constitute a compressor displacement control valve assembly 27 mounted to the flange member 19, thus forming part of the compressor 29.

The flange member 19 further includes at its end opposite to the control valve 27 an integral tube portion 28 whose free end is sealingly connected to the cylinder block 1 and front housing 6 in such a way that the suction passage 19*c* may communicate at all times with the crankcase 7 through a bypass passage 28*a* in the tube 28 for allowing part of the refrigerant gas in the suction passage 19*c* to be admitted into the crankcase 7 though the bypass passage 28*a*. According to the invention, the end of the bypass passage 28*a* adjacent to the suction passage 19*c* may be located anywhere between the evaporator 34 and the control valve 27 (or the control port 24). In the illustrated embodiment, the interior of the suction passage 19*c* is referred to as pre-valve suction passage 36 and the interior extending from the control port 24 to the suction chamber 4 as post-valve suction passage 37, respectively. The compressor 29 further has a discharge flange member (not shown) which is connected to the discharge line 30 extending to the condenser 31 in the air conditioning system.

The following will provide description of the operation of the above compressor 29 specifically with reference to the control valve 27.

With the ambient temperature in passenger's compartment of an automobile is fairly high, e.g. when the engine has just been started, and therefore the air conditioning capacity demand or cooling load is high, the evaporator's temperature is elevated and, therefore, the saturation pressure of the refrigerant gas is fairly high. Consequently, evaporator pressure $P_e$, or evaporating pressure of the refrigerant, in the pre-valve suction passage 36 is increased, and the pressure in the pressure-responsive cell 23 communicating with the passage 36 is increased, accordingly, ultimately to such an extent that the valve body 21 is moved to thereby wide-open the control port 24 while overcoming the combined force by the atmospheric pressure in the cell 25 and by the pressure exerted by the spring 25. Under such high refrigerating capacity demand, pressure $P_c$ of the refrigerant gas (e.g. about 4 atm.) in the crankcase 7 that is in direct communication with the suction passage 36 is substantially at the same level as the evaporator pressure $P_e$ and, on the other hand, pressure $P_s$ in the suction chamber 4 is then just slightly lower than the crankcase pressure $P_c$ because of suction effect by the pistons 10, so that the pressure differential $\Delta P$ (or $P_c-P_s$) is kept substantially at its minimum value. Therefore, the compressor 29 is operated at its maximum capacity with the pistons 10 reciprocating at their full displacement stroke and the wobble plate 17 positioned at its maximum angle of tilt.

As the refrigerating capacity demand is reduced with a drop of the ambient temperature in the car interior, the saturation pressure of the refrigerant is dropped with a decrease of the evaporator temperature. Simultaneously, the evaporator pressure $P_e$, as well as the pressure in the cell 23, are also decreased. As the evaporator pressure $P_e$ is thus decreased, the valve body 21 starts to move from the wide-open position shown in FIG. 1 to a position wherein the pressure in the cell 23 then counterbalances the combined force of the atmospheric pressure and pressure of the spring 25. Because the flow of the refrigerant gas through the control port 24 is thus throttled, drop of the evaporator pressure $P_e$ is restricted and the suction pressure $P_s$ is decreased, with the result that the pressure differential $\Delta P$ is increased. Consequently, the length of displacement stroke of the pistons 10 is shortened and the compressor is brought to an operation at an intermediate or partial capacity. During this partial capacity operation, the valve body 21 is moved to and fro in response to the fluctuating cooling capacity demand within the partial capacity range where the pressure in the pressure-responsive cell 23 can counterbalance the combined force of the atmospheric pressure in the cell 26 and the pressure of the spring 25.

When the evaporator pressure $P_e$ is further dropped, with a decrease of the ambient temperature to an optimum level, to such an extent that the pressure $P_e$ is lower than the combined force of the atmospheric pressure and spring 25 in the cell 26, the control port 24 is closed off by the valve body 21. With the control port 24 thus closed, further drop of the evaporator pressure $P_e$ is prevented and maintained substantially at $P_{e0}$ to keep the evaporator temperature above a level below which the evaporator 34 may be frosted, and as a matter of course the crankcase pressure $P_c$ is maintained substantially at the same level as evaporator pressure $P_e$. On the other hand, the suction pressure $P_s$ is decreased to such an extent that the pressure differential $\Delta P$ reaches its maximum value, thus resulting in the compressor operating at its minimum displacement with the wobble plate 17 positioned at its minimum angle of tilt. With a slight rise of the temperature during this maximum displacement operation, the control port 24 is opened accordingly until the evaporator pressure $P_e$ is dropped again. In this way, the compressor is operated to supply cooled air of the desired temperature to the car interior while preventing the evaporator 34 from being frosted.

Supply of the refrigerant gas into the suction chamber 4 through the suction passage 19*c* will be stopped if the compressor is operated continuously with the control port 24 closed completely by the valve body 21. During such operation, however, a small amount of refrigerant gas flows into each compression chamber through a clearance between the piston 10 and the cylinder 9 under the influence of vacuum that is created in the compression chamber on each suction stroke of the piston 10, thus allowing part of the lubricating oil entrained in the refrigerant gas to be applied to the sliding surfaces of the pistons 10 and of the wobble plate 17 in the crankase 7 for lubrication of such surfaces. Therefore, provision of a large diameter for the bypass passage 28*a* in the flange member 19, as shown in the illustrated embodiment, can facilitate smooth flowing of the refrigerant gas into the crankcase 7 to permit ensured lubrication of the above surfaces.

In the event that the speed of the drive shaft 8 is increased at a rapid rate by acceleration of the engine, there will occur a rapid drop in the suction pressure $P_s$. Accordingly, the refrigerant gas pressure adjacent the control port 24 is dropped to thereby cause the port to be closed, and the pressure in the pre-valve suction passage 36 can be thus held substantially at $P_{e0}$. Because the crankcase-suction pressure differential $\Delta P$ then becomes greater and the displacement of the compressor is reduced thereby, load to be imposed on the engine by the compressor can be lessened so as not to affect the accelerating performance of the engine. After the acceleration is over, the suction pressure $P_s$ can be increased to be restored quickly to the level before the acceleration. Because the pressure $P_c$ in the crankcase chamber 7 is kept at $P_{e0}$, the pressure differential $\Delta P$, hence the compressor's displacement, can be restored rapidly to the previous level before the acceleration. In this way, the temperature in the passenger's compartment, if any drop thereof took place during the acceleration, can be returned to the optimum level soon after the acceleration. Thus, because shaft seal surfaces in the crankcase will not be placed under the influence of excessive variation in pressure, the shaft seals of the compressor of the invention is free of any damage resulting from frequent changes in crankcase pressures taking place each time accelerating operation is performed with conventional compressors.

In this embodiment of the invention, an excess of the blow-by gas escaping from the compression chamber into the crankcase 7 due to high pressure in the compression chamber during full stroke operation under an extremely high cooling capacity demand, is returned through the bypass passage 28*a* to the suction chamber 4, so that drop of the compressor's working capacity and an excessive increase of the crankcase pressure $P_c$ can be forestalled successfully. Additionally, because the control valve 27 is incorporated in the flange member 19, its casing parts can be shared in common by the valve 27 and the flange member 19 for reduction of the number and hence the cost of component parts of the compressor and also for ease of installation thereof on the vehicle.

Figure 3:
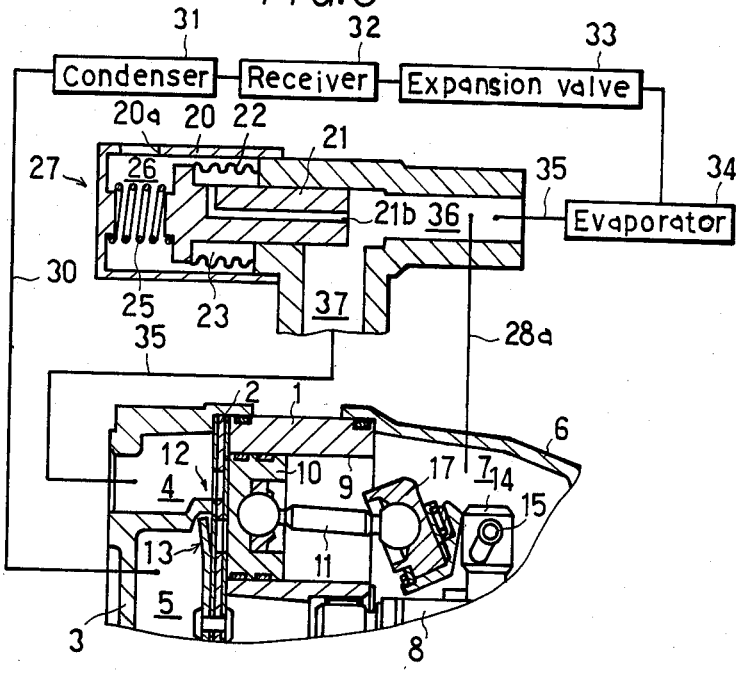
FIGS. 3 to 5 are cross-sectional views similar to that of FIG. 1, but showing other modified arrangement of the displacement control valve, respectively, according to the present invention.

Now referring to FIG. 3 showing the second embodiment of the invention, this differs from the first preferred embodiment in that the control valve 27 of the former is connected to the compressor by separate lines such as tubes. According to this embodiment, the control valve 27 may be provided separately from and connected to an existing compressor by any suitable tube means.

Figure 4:
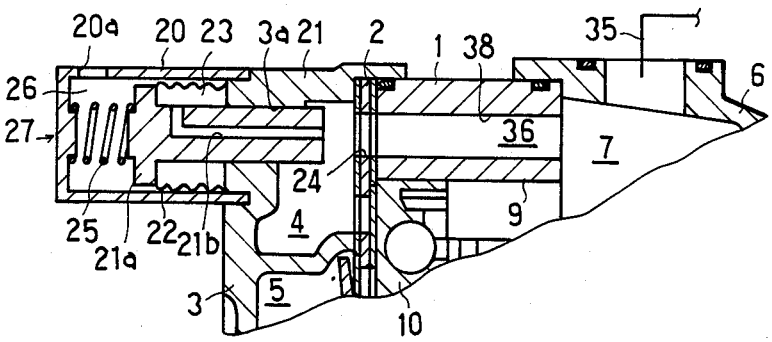

There is shown in FIG. 4 another modified embodiment in accordance with the present invention, wherein the control valve 27 is fitted to the rear housing 3 and a suction gas passage 38 is formed in the cylinder block 1 and valve plate 2 to establish communication between the crankcase 7 and suction chamber 4. The pre-valve suction passage 36 is defined by the suction passage line 35, crankcase chamber 7 and suction passage 38. The control throttling port 24 for the valve body 21 is formed in the valve plate 2, and the suction chamber 4 doubles as the post-valve suction passage 37 of the first and second embodiment. In this modified practice, because the compressor is so constructed that the refrigerant gas is circulated through the crankcase 7, it is easier for the crankcase to hold the lubricating oil entrained in the refrigerant, thus making possible adequate lubrication of the compressor mechanism in the crankcase 7 including major sliding parts requiring constant lubrication. An additional advantage of this embodiment is that removing the control valve 27 from the compressor and then closing the opening 3*a* in the rear housing 3 by any suitable plugging means can convert the compressor to the type which is capable of providing a constant delivery or capacity. As it would be apparent to those skilled in the art, a plurality of suction passages 38 may be formed, in which case the control valve 27 will have to be provided for each such passage 38.

Figure 5:
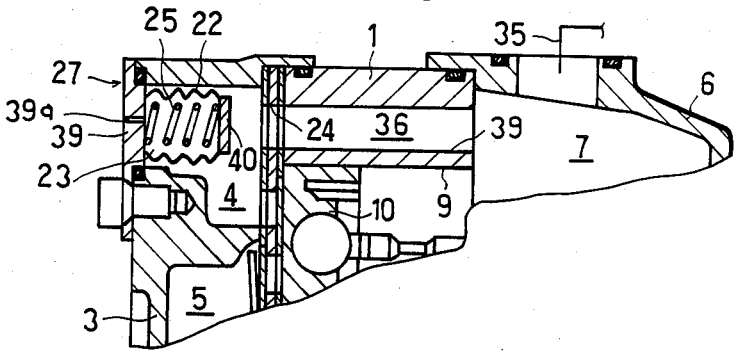

Referring to FIG. 5 which illustrates a further modified embodiment of the invention, its control valve 27 comprises a lid 39 plugged into an opening of the rear housing 3 and having a vent hole 39*a*, bellows 22 mounted at one end to the inner side of the lid 39, valve 40 fitted to the other end of the bellows 22, and spring 25 interposed between the valve 40 and lid 39. This embodiment of the compressor is advantageous in that the control valve 27 can be incorporated in the compressor without protruding therefrom, with the result that the compressor can be built compact in size.

While the invention has been described and illustrated specifically with reference to a desired embodiment, it is to be understood that the invention can be changed or modified without departing from the spirit or scope thereof.

What is claimed is:

1. A variable displacement refrigerant compressor of the variable angle wobble plate type arranged in a refrigerating system having an evaporator connected to the suction side of said compressor, comprising:

a cylinder block;

a plurality of cylinders formed in said cylinder block and each having therein a reciprocable piston;

a suction chamber;

a crankcase formed in constant communication with the outlet of said evaporator;

a variable angle wobble plate drive mechanism disposed in said crankcase and having a rotatable drive shaft, a drive plate rotatable with said shaft and tiltable with respect to the axis thereof and a non-rotary wobble plate connected to each said piston by a connecting rod and tiltable with said drive plate in response to the pressure differential between said crankcase and suction chamber so as to change the stroke of said reciprocable piston and hence the displacement of the compressor; and control valve means operable in response to evaporator pressure for effecting controlled communication between said evaporator and suction chamber.

2. A variable displacement refrigerant compressor according to claim 1, wherein said control valve means includes a control port disposed between said evaporator and suction chamber and operates so as to control the evaporator pressure by throttling the refrigerant gas passing through said control port with a decrease in the evaporator pressure.

3. A variable displacement refrigerant compressor according to claim 2, said control valve means has a first position where said control port is wide open, corresponding to maximum displacement of the compressor and a second position where where said control port is closed off, corresponding to minimum displacement of the compressor.

4. A variable displacement refrigerant compressor according to claim 3, wherein said control valve means is operable in response to a drop in suction pressure taking place in said suction chamber, whereby said control port then opened is closed off for placing the compressor under the minimum displacement.

5. A variable displacement refrigerant compressor according to claim 2, wherein said control valve means further includes a slidable valve body, bellows means operable in response to increasing evaporator pressure to thereby move said valve body toward a position where said control port is wide open, corresponding to maximum displacement of the compressor, and spring means for urging said valve body toward a position where said control port is closed off, corresponding to minimum displacement of the compressor.

6. A variable displacement refrigerant compressor according to claim 2, further comprising a refrigerant gas passage extending from the evaporator to the suction chamber, said passage having a first passage upstream of said control port and a second passage downstream thereof.

7. A variable displacement refrigerant compressor according to claim 2, further comprising a refrigerant gas passage extending from the evaporator to the suction chamber by way of said crankcase so that the refrigerant gas may be passed through said crankcase before it reaches said control valve.

* * * * *